US006091193A

United States Patent [19]

Kuwamoto et al.

[11] Patent Number: 6,091,193

[45] **Date of Patent: *Jul. 18, 2000**

[54] MESH GRID WITH PROTRUDING PORTION

[75] Inventors: Michio Kuwamoto; Teruo Yamaguchi, both of Mobara, Japan

[73] Assignee: Futaba Denshi Kogyo K.K., Mobara, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/825,160

[22] Filed: Mar. 26, 1997

[51] Int. Cl.[7] ..... H01J 31/15

[52] U.S. Cl. ..... 313/497; 313/292; 313/269; 313/517

[58] Field of Search ..... 313/292, 517, 313/519, 495, 496, 497, 269

[56] References Cited

U.S. PATENT DOCUMENTS

| | | | |
|---|---|---|---|
| 3,849,694 | 11/1974 | Harvey et al. | 313/519 |
| 4,023,876 | 5/1977 | Fukunaga et al. | 313/497 |
| 4,164,683 | 8/1979 | Nakamura et al. | 313/496 |
| 4,220,894 | 9/1980 | Kobayakawa et al. | 313/496 |
| 4,298,823 | 11/1981 | Kawasaki et al. | 313/497 |
| 4,472,658 | 9/1984 | Morimoto et al. | 313/497 |
| 5,568,012 | 10/1996 | Mohri et al. | 313/517 |

FOREIGN PATENT DOCUMENTS

| | | | |
|---|---|---|---|
| 63-146952 | 6/1988 | Japan | C08L 23/10 |

*Primary Examiner*—Michael H. Day
*Attorney, Agent, or Firm*—Oblon, Spivak, McClelland, Maier & Neustadt, P.C.

[57] ABSTRACT

A mesh grid for a fluorescent display tube capable of effectively preventing a deformed mesh from being in contact with fluorescent substance without disturbing indications on an anode display unit. The mesh grid is mounted over an anode substrate with adhesive. A mesh of the mesh grid is disposed over the anode display unit including a plurality of anode segments. The mesh is formed in a hexagonal pattern. On the mesh, protruding portions directed to the anode display unit are formed. The protruding portions are disposed at positions opposing the anode display unit but not opposing each of the anode segments. The protruding portions are formed by pressing the mesh toward the anode display unit with each intersection of fine wires in a hexagonal pattern. If the mesh grid is deformed toward the anode substrate due to heat or the like, the protruding portions come into contact with the anode substrate, thereby preventing a portion of the mesh provided with no protruding portion from being in contact with fluorescent substance.

19 Claims, 3 Drawing Sheets

MESH GRID WITH PROTRUDING PORTION

BACKGROUND OF THE INVENTION

1. Field of the Invention

This invention relates to a mesh grid for a fluorescent display tube in which a fluorescent substance is prevented from adhering to the mesh because of deformation due to generated heat, vibration or the like.

2. Description of the Prior Art

Fluorescent display tubes having a general construction have various types of electrodes and the like in the interior of an envelope held in a highly vacuum state. For example, an anode display unit including usually a plurality of anode segments coated with a fluorescent substance is formed inward above the anode substrate which is one component of the envelope. Inside of the envelope, a grid for controlling electrons is provided over the anode display unit and a cathode is provided further over the grid as an electron source.

As the grid, a so-called spacer-frame-type grid, a so-called mesh grid and the like have been well known. In the spacer-frame-type grid, a mesh which is a different body from a frame is installed inside of the frame. In the case of the spacer-frame-type, a frame member called a spacer frame in which the frame, a mesh, other electrodes and the like are mounted is positioned at an appropriate position on the anode substrate and then the aforementioned anode and other components are disposed at predetermined positions on a top surface of the anode substrate. Then, a box-shaped container portion is fixed to the top surface of the anode substrate so as to cover the components. A lead connecting the space frame and the frame is fixed to a position in which the envelope is sealed.

Further, as the aforementioned grid, a mesh grid 100 shown in FIGS. 7 (*a*) and 7 (*b*) has been well known. This mesh grid includes an edge portion 101 and a mesh portion 102 which are integrally formed from a piece of metallic material by for example, etching or the like. A so-called over-mounting-type structure is utilized to install this mesh grid inside of the envelope. Here, the mesh portion 102 is allocated over the anode display unit 104 on the anode substrate 103 and then a leg portion 105 formed on the edge portion 101 of the mesh grid 100 is directly fixed to the anode substrate 103 by an adhesive.

Recently, the fluorescent display tube has been widely used in vehicles. As the fluorescent display tube is to be mounted on a vehicle, the mesh grid is often applied because it can be allocated in a relatively free shape or arrangement corresponding to a high density display pattern. The mesh grid is more likely to be deformed than the grid installed on the frame like in the aforementioned spacer-frame-type. Thus, the mesh thereof is sometimes deformed toward the anode substrate 103 as shown in FIG. 8 due to vibration caused when a vehicle is running or when heat is generated when the fluorescent display tube is lit, such that it is in contact with the fluorescent substance of the anode display unit 104. In the fluorescent display tube mounted on a vehicle, a distance between the mesh grid and the anode display unit is set relatively small to secure visibility under a strong daylight. Thus, this is one reason why the mesh is likely to go into a contact with the anode display unit.

If the mesh grid is in contact with the fluorescent substance, the fluorescent substance adheres to a rear side of the mesh portion. Then, the fluorescent substance adhering to the mesh grid emits light when this fluorescent display tube is driven, thereby disturbing indications. As described before, the fluorescent display tube mounted on a vehicle needs to secure visibility under a strong daylight. For this reason, in the daytime, an anode voltage is increased to intensify brightness. Thus, this unnecessary light caused by the flouorescent substance adhering to the mesh grid is not so visible. However, because light emitted in the daytime is too strong for the eyes of a driver, the anode voltage of the fluorescent display tube of a display panel is decreased at night time interlinked with a switch-on of head lamps or the like. In this case, a dimming light emission method for decreasing the brightness of the anode display unit is utilized. Thus, if the fluorescent substance adheres to the mesh grid of the fluorescent display tube mounted on a vehicle, the unnecessary light emission is particularly visible at night time thereby disturbing visibility of the display panel.

A proposal for preventing the aforementioned deformation of the mesh grid has been made in Japanese Published Utility Model No. Hei 1-41154 (Japanese Utility Model Laid-Open No. Sho 60-96763). According to this proposal, as shown in FIGS. 9 (*a*) and 9 (*b*), a portion having no mesh is left on a periphery or inside of the mesh grid and then nail shaped auxiliary tabs are formed on that portion by punching out using a press, so as to be used as a support if the mesh grid is deformed toward the anode substrate.

However, such a support structure needs a wide area in the small mesh grid. Thus, it is difficult to apply this support structure particularly to the fluorescent display tube having a high display density, mounted on a vehicle. Further depending on a shape of the segment of the anode display unit, this structure may not be sufficient.

SUMMARY OF THE INVENTION

Accordingly, an object of the present invention is to solve the above described problem and provide a mesh grid for a fluorescent display tube capable of effectively preventing a deformed mesh from being in contact with fluorescent substance without disturbing indications on an anode display unit, regardless of a segment pattern of the anode display unit.

According to a first aspect of the present invention, there is provided a mesh grid for a fluorescent display tube which is disposed over an anode display unit including anode segments in an envelope of the fluorescent display tube, the mesh grid including protruding portions directed to the anode display unit at a position opposing a portion of the anode display unit other than the anode segments.

According to a second aspect of the present invention, there is provided a mesh grid for the fluorescent display tube as in the first aspect, wherein the protruding portion is not in contact with the anode display unit other than the anode segments when the fluorescent tube is not lit.

According to a third aspect of the present invention, there is provided a mesh grid for the fluorescent display tube as in the first and second aspect, wherein the a protruding portion is formed by pressing a mesh with an intersection of fine wires of the mesh constructing the mesh grid for the fluorescent display tube positioned in the center.

DETAILED DESCRIPTION OF THE PREFERRED EMBODIMENTS

Embodiments of the present invention will be described with reference to FIGS. 1–6.

Figure 1:
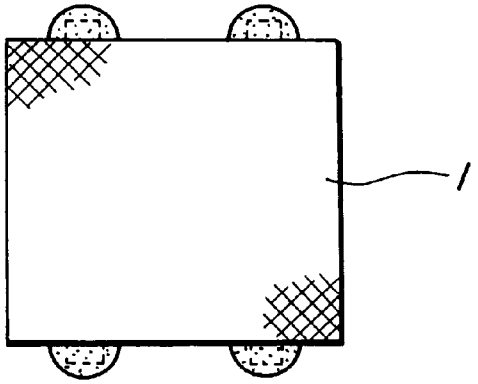
FIG. 1 is a plan view of a mesh grid according to an embodiment of the present invention.
Figure 2:
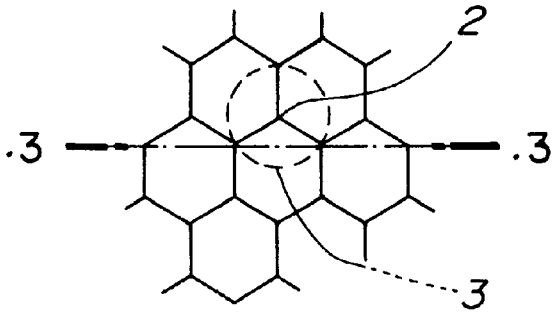
FIG. 2 is an enlarged plan view of the mesh of the mesh grid shown in FIG. 1.

FIG. 1 is a plan view of a mesh grid 1 (hereinafter referred to as mesh grid 1) for a fluorescent display tube according to this embodiment. The mesh grid 1 is mounted on an anode substrate of the over-mounting-type structure described previously. A mesh of the mesh grid 1 is disposed over an anode display unit including a plurality of anode segments. FIG. 2 is an enlarged view of the mesh of the mesh grid shown in FIG. 1. The mesh of this mesh grid is constructed of fine wires formed in a shape of a hexagonal pattern.

Figure 3:
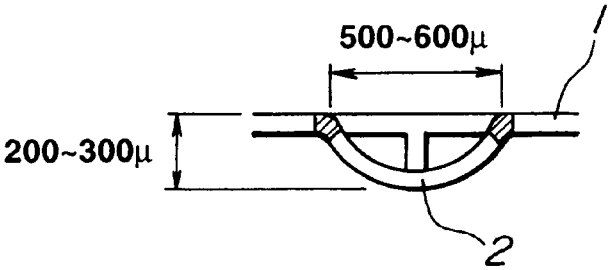
FIG. 3 is an enlarged sectional view taken along the cut-out line in FIG. 2.

FIG. 3 is a sectional view taken along the cut-out line A—A shown in FIG. 2. In this mesh grid 1, protruding portions 2 which are of a substantially semi-circular shape and directed to an anode display unit (not shown) are formed. The protruding portion 2 is formed by pressing the mesh with an intersection of the fine wires formed in hexagonal pattern as a center of the pressing by means of a punch 3. The punch for use in this embodiment is a round bar having a semi-spherical end portion.

As shown in FIG. 3, the protruding portion 2 of this embodiment has a diameter of substantially 500–600 $\mu$m and a height of 200–300 $\mu$m. If a distance between a surface of the anode substrate on which the anode display unit is formed and the mesh grid 1 is approximately 500 $\mu$m and a thickness of the anode segment formed on the anode substrate is approximately 100 $\mu$m, a distance between the fluorescent substance on the surface of the anode segment and an front end of the protruding portion is 100–200 $\mu$m. A shape and dimensions of the protruding portion 2 may be set arbitrarily depending on a size of the punch 3 for use in the processing, a part of the mesh to be processed, and processing conditions by the press or the like.

Figure 6:
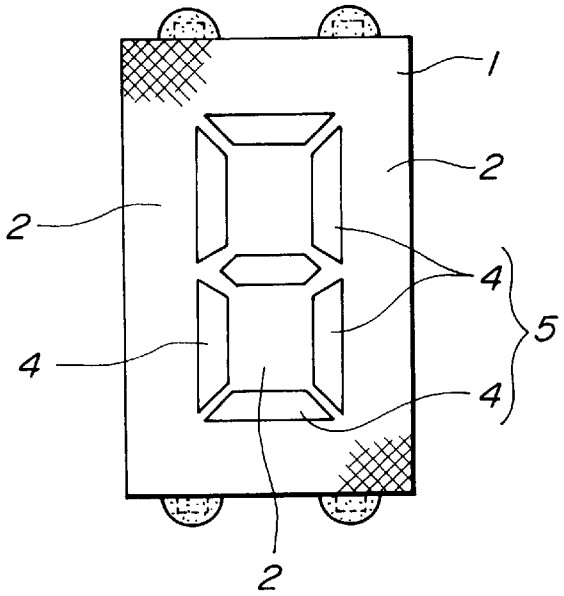
FIG. 6 is a plan view of an anode display unit and a mesh grid of an example of the embodiment of the present invention.
Figure 7A:
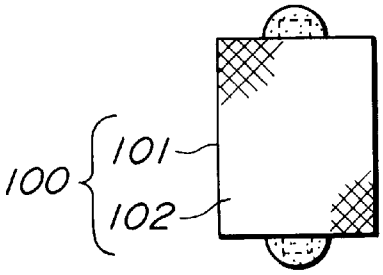
FIG.7(a) (PRIOR ART)
FIG. 7 (*a*) is a plan view of a conventional mesh grid of the over-mounting-type structure and FIG. 7 (*b*) is a side view of the same.
Figure 7B:
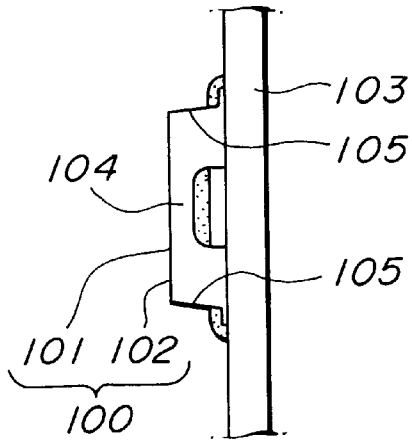
FIG.7(b) (PRIOR ART)
Figure 8:
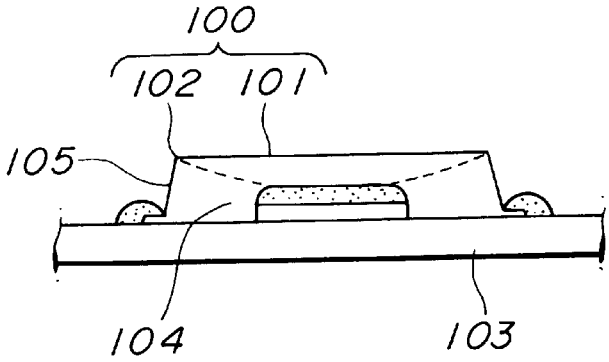
FIG.8 (PRIOR ART)
FIG. 8 is a side view showing a state in which the conventional mesh grid of the over-mounting-type structure is deformed toward the anode substrate.
Figure 9A:
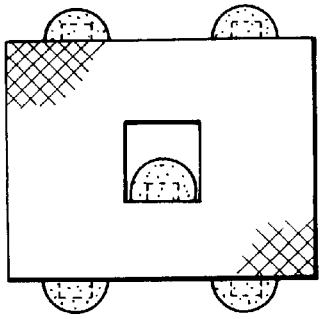
FIG.9(a) (PRIOR ART)
FIGS. 9 (*a*) and 9 (*b*) are a plan view of the conventional mesh grid having auxiliary tab.
Figure 9B:
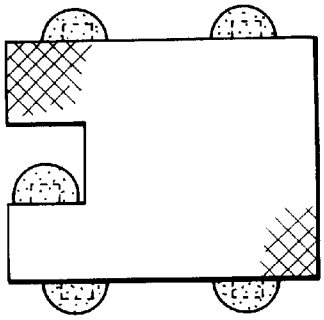
FIG.9(b) (PRIOR ART)

The protruding portions 2 are provided at positions which oppose the anode display unit but do not oppose each of the plural anode segments disposed in the anode display unit. For example, FIG. 6 shows the anode display unit 5 for indicating characters or numerals, in which seven anode segments are disposed in a shape of a numeral "8". The mesh grid 1 according to this embodiment is disposed above this anode display unit. In this mesh grid 1, the protruding portions 2 are formed and disposed at positions which do not overlap the respective anode segments 4 when viewed from a direction in which the anode display unit 5 is usually seen.

In this embodiment, the protruding portions 2 of the mesh grid 1 are never in contact with the anode substrate when the fluorescent substances are not illuminated. If the mesh grid 1 is deformed toward the anode substrate due to heat or the like when the fluorescent substances are illuminated, it is never in contact with the fluorescent substances of the anode segments 4 because the protruding portions 2 are located at positions which do not oppose the anode segments. When the dimensions shown previously for example are utilized, if the mesh grid 1 is deformed by 100–200 $\mu$m toward the anode substrate, the protruding portions 2 are in contact with the anode substrate, thereby preventing a portion of the mesh 1 having no protruding portions 2 from being in contact with the fluorescent substance.

As shown by broken lines in FIG. 2, a radius of the cylindrical punch 3 in this embodiment is the same as the length between the intersections of the fine wires forming the mesh. It is recommended to utilize a NC press machine capable of setting a processing position accurately in order to make the center of the punch 3 coincide with the intersection of the fine wires for pressing.

According to this embodiment, in the mesh grid 1 which is more easily deformed as compared with the spacer-frame-type grid, the mesh is provided with the protruding portions 2. Thus, it is possible to prevent the mesh from being in contact with the fluorescent substance on the anode segments when the mesh is deformed due to heat or the like. Particularly in the fluorescent display tube mounted on a vehicle, it is easily affected by vibration because a distance between the anode segment and the grid is small; if fluorescent substance adheres to the grid, unnecessary light caused due to the aforementioned dimming light emission method is conceivable at night times. Thus, the mesh grid 1 equipped with the protruding portions 2 according to this embodiment can solve these problems while being capable of high density display. Therefore, the mesh grid according to this embodiment is very effective for practical use.

The protruding portion 2 of this embodiment is smaller than the conventional auxiliary tab as a support for use when the grid is deformed. Further, it can be provided without consuming a display space in even the fluorescent display tube mounted on a vehicle having a high display density. Further, because originally the mesh is formed in such a fine structure that does not obstruct drivers seeing the anode display unit, the protruding portions 2 provided on the mesh does not obstruct drivers view on the display.

The protruding portions 2 are formed by pressing the mesh of the mesh grid 1 by a press. Thus, it is possible to design and produce the mesh grid 1 first and then form the protruding portions 2 on a subsequent process corresponding to an allocation pattern of the anode segments depending on the type of the fluorescent display tube. In the case of the conventional auxiliary tab, the position thereof must be determined at a design stage and it must be formed at the same time when the grid itself is produced. Thus, the conventional auxiliary tab cannot be used widely and is more disadvantageous as compared with this invention.

Figure 4:
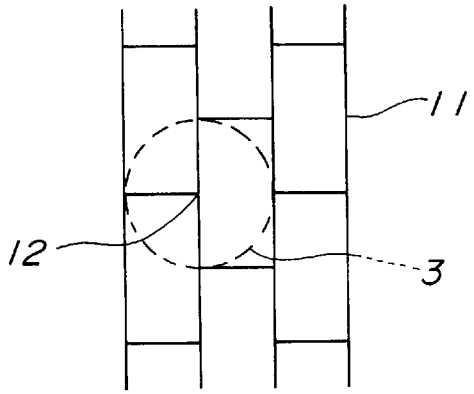
FIG. 4 is a plan view showing a mesh grid according to another embodiment of the present invention.

FIG. 4 shows another embodiment of the mesh grid according to this invention. Although the mesh grid 1 of the previous embodiment is of hexagonal pattern, this is of lattice shape. In the case of the mesh grid 11, if it is pressed toward the anode with an intersection of the fine wires constructing the lattice as a center of the pressing, the protruding portion 12 having the same function as the protruding portion 2 can be formed.

Figure 5:
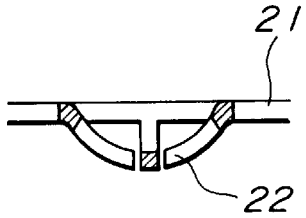
FIG. 5 is an enlarged sectional view of a mesh grid according to another embodiment of the present invention.

FIG. 5 shows still another embodiment of the mesh grid according to this invention. In the protruding portion 22 of this mesh grid 21, the fine wire forming the mesh is cut at a protruding end portion as a result of press formation. The cut fine wire becomes a cantilever structure so that a spring-like elasticity is obtained. Thus, if the mesh grid 21 is deformed to be in contact with the anode substrate, it can absorb the impact caused when it comes into a contact therewith. If a press force is set considering material or the like of the fine wire forming the mesh grid 21, it is possible to form the protruding portion 2 such that the cut fine wire possesses an appropriate elasticity.

Although the protruding portion is formed at the mesh grid in the embodiment described above, it is permissible to provide the mesh portion in the grid of the spacer-frame-type with the above described protruding portion. Because, in the spacer-frame-type grid, the mesh is welded to a frame different from the mesh, it is less likely to be affected by vibration, heat or the like than the above mesh grids 1, 11, 21. However, if the protruding portion is provided on the mesh, if it is deformed, it is possible to decrease a possibility that a fluorescent substance adheres to the mesh.

In the above described embodiments, the protruding portions are formed in a semi-spherical shape. However, it is possible to form arbitrary shape protruding portions by determining the shape of the punch to be an appropriate shape, such as conical shape, pyramid shape, truncated cone shape, truncated pyramid shape, convex shape or the like.

Some types of mesh grid are not designed for particular anode display unit, but can be applied to anode display units of various display patterns. This is a general purpose mesh grid which is formed on a common frame by arranging a plurality of unit mesh grids which are of rectangular shape and having a small width in a width direction thereof. In use of this type of the mesh grid, depending on a transverse length of the anode display unit of a fluorescent display tube on which this mesh grid will be applied, a necessary number of the unit mesh grids are removed together from the frame and then mounted over the anode substrate. Thus, the general purpose mesh grid can be applied to various types of the fluorescent display tubes regardless of the length of the anode display unit in the traverse direction. Because the general purpose mesh grid can be applied to the anode display units having various display patterns, it is highly effective for this invention to be capable of forming protruding portions corresponding to a particular display pattern by pressing on a subsequent process.

Because, in the mesh grid for the fluorescent display tube according to the present invention, the protruding portions directed to the anode substrate are formed at positions which do not oppose the anode segments, the following effects can be obtained.

(1) If the mesh grid is deformed due to vibration and heat or the like, the mesh grid 1 is prevented from being in contact with the fluorescent substances. Thus, it is possible to prevent an occurrence of a unfavorable phenomenon in which the fluorescent substance adhering to the mesh grid may unnecessary emit light. Thus, this invention is particularly effective for the fluorescent display tube mounted on a vehicle.

(2) Because the protruding portions can be formed in such a fine size of, for example, 0.5–0.6 mm in diameter, they can be formed in gap area between the anode segments even in a portion in which the display pattern is dense, without any trouble. Further, because the protruding portions are so small that they are not an obstacle to the display unlike the conventional auxiliary tab.

(3) Because the protruding portions 2 have only to be provided at any position not opposing the anode segments in the mesh grid, existence of the protruding portions will not restrict a design of the mesh grid.

(4) Thus, it is possible to first produce the mesh grid and then construct the protruding portions corresponding to a display pattern of the anode display unit of the fluorescent display tube to be applied on subsequent process. Further, it is easy to recognize effects of the protruding portions preventing the mesh grid from being in contact with the anode display unit and then change positions of the protruding portions to more effective positions.

What is claimed is:

1. A mesh grid disposed over an anode display unit including at least one anode segment, said mesh grid comprising:

a plurality of intersecting mesh elements having at least one protruding portion; and said at least one protruding portion formed from said plurality of intersecting mesh elements and protruding toward said anode display unit so as not to contact said anode segment when the anode display unit is not in use and disposed interior to sides of said mesh grid.

2. The mesh grid according to claim 1, wherein said at least on protruding portion protrudes towards and within an area of said anode display unit not containing said at least one anode segment.

3. The mesh grid according to claim 1, wherein said plurality of intersecting mesh elements comprise fine wires.

4. The mesh grid according to claim 1, wherein said at least one protruding portion is formed at an intersection point of said plurality of intersecting mesh elements.

5. The mesh grid according to claim 1, wherein said at least one protruding portion contacts said anode display unit.

6. The mesh grid according to claim 1, wherein said at least one protruding portion comprises at least one of a hexagonal shape, lattice shape, conical shape, pyramidal shape, truncated cone shape, truncated pyramidal shape, and convex shape.

7. The mesh grid according to claim 1, wherein said at least one protruding portion is cut at a tip thereof.

8. The mesh grid according to claim 1, wherein said at least one protruding portion is formed of a substantially semi-circular shape having a diameter of approximately 500–600 $\mu$m and a height of approximately 200–300 $\mu$m.

9. The mesh grid according to claim 1, wherein said mesh grid covers a fluorescent display in an automobile.

10. The mesh grid according to claim 1, wherein said at least one protruding portion extends towards said anode display unit and between anode segments.

11. In a fluorescent display, the improvement comprising:

an anode display unit having at least one anode segment; and a plurality of intersecting mesh elements having at least one protruding portion, said at least one protruding portion formed from said plurality of intersecting mesh elements and protruding toward said anode display unit so as not to contact said anode segment when the anode display unit is not is use and disposed interior to sides of said mesh grid.

12. The fluorescent display according to claim 11, wherein said at least one protruding portion protrudes towards an area of said anode display unit not containing said at least one anode segment.

13. The fluorescent display according to claim 11, wherein said plurality of intersecting mesh elements comprise fine wires.

14. The fluorescent display according to claim 11, wherein said at least one protruding portion is formed at an intersection point of said plurality of intersecting mesh elements.

15. The fluorescent display according to claim 11, wherein said at least one protruding portion contacts said anode display unit.

16. The fluorescent display according to claim 11, wherein said at least one protruding portion comprises at least one of a hexagonal shape, lattice shape, conical shape, pyramidal shape, truncated cone shape, truncated pyramidal shape, and convex shape.

17. The fluorescent display according to claim 11, wherein said at least one protruding portion is cut at a tip thereof.

18. The fluorescent display according to claim 11, wherein said at least one protruding portion is formed of a substantially semi-circular shape having a diameter of approximately 500–600 $\mu$m and a height of approximately 200–300 $\mu$m.

19. The fluorescent display according to claim 11, wherein said at least one protruding portion extends towards said anode display unit and between anode segments.

* * * * *

UNITED STATES PATENT AND TRADEMARK OFFICE

CERTIFICATE OF CORRECTION

PATENT NO. : 6,091,193

DATED : July 18, 2000

INVENTOR(S): Michio KUWAMOTO et al.

It is certified that an error appears in the above-identified patent and that said Letters Patent is hereby corrected as shown below:

On the title page, item [30], has been omitted. The Foreign Application Priority Data should be:

--[30] Foreign Application Priority Data

Mar. 27, 1996 [JP] Japan.....8-072528--

Signed and Sealed this

Seventeenth Day of April, 2001

*Attest:*

Nicholas P. Godici

NICHOLAS P. GODICI

*Attesting Officer*

*Acting Director of the United States Patent and Trademark Office*